United States Patent [19]

Plunkett

[11] 4,122,424

[45] Oct. 24, 1978

[54] BOBBIN ASSEMBLY

[75] Inventor: James P. Plunkett, West Dundee, Ill.

[73] Assignee: Coils, Inc., Huntley, Ill.

[21] Appl. No.: 865,734

[22] Filed: Dec. 29, 1977

[51] Int. Cl.[2] ..... H01F 15/10

[52] U.S. Cl. ..... 336/107; 339/220 R; 336/192

[58] Field of Search ..... 339/220 R, 220 C, 61 R, 339/61 L, 61 C, 61 M, 60 R, 60 C, 60 M; 336/192, 107; 310/71

[56] References Cited

U.S. PATENT DOCUMENTS 2,438,075 3/1948 Smith ..... 339/220 R X

FOREIGN PATENT DOCUMENTS 1,185,679 3/1970 United Kingdom ..... 339/220 R

*Primary Examiner*—Thomas J. Kozma

*Attorney, Agent, or Firm*—Dressler, Goldsmith, Clement, Gordon & Shore, Ltd.

[57] ABSTRACT

An electrical coil having a bobbin including a central core and a pair of spaced parallel flanges extending from the core with a coil of fine wire wound upon the central core is disclosed herein. One of the flanges has a terminal block which supports connections between the respective ends of the fine wire and terminal leads that extend away from the coil. Each connection consists of a tubular member that has an enlarged head engaging one surface of the terminal block with the terminal block having an enlarged opening surrounding the tubular member and the free end of the fine wire is connected to the enlarged head. The terminal lead wire can be connected directly into the tubular member or be connected through a sleeve that can be telescoped over the tubular member. The tubular member may also be used as a plug-in arrangement.

7 Claims, 4 Drawing Figures

BOBBIN ASSEMBLY

BACKGROUND OF THE INVENTION

The present invention relates generally to bobbin assemblies or electrical coils that consist of a spool like bobbin of molded plastic insulating material that has many turns of fine wire wound thereon and a pair of terminal leads connected to opposite ends of the fine wire.

In the field of bobbin assemblies, one area that has received a remarkable degree of attention is the manner in which the terminal leads are connected to the respective ends of the coil of fine wire which is wound about the center of the bobbin. Because the wire which forms the coil or core is extremely thin, difficulties have been encountered in making a permanent connection between the ends of the thin wire and the relatively larger diameter conductor portions of the terminal leads that extend from the bobbin assembly. One of the most common ways of interconnecting the fine wires and the terminal leads is to utilize separate elements that are connected to both the terminal wire conductor and the fine wire and are supported on the bobbin assembly. Examples of this type of separate connector element are illustrated in U.S. Pat. Nos. 3,609,616 and 3,932,828.

Another example of a type of support for supporting the lead wires for connection to the ends of the fine wire is illustrated in Davis U.S. Pat. No. 3,453,575.

One of the problems encountered in selecting a proper connection means for interconnecting terminal leads and ends of the core of fine wire is the capability of being able to automatically assemble the various components in a machine at a minimum cost. Of course, one of the cost factors involved is the amount of material required for making the connection as well as the steps that are necessary for interconnecting the various components.

SUMMARY OF THE INVENTION

According to the present invention, a unique separate connector member for interconnecting the terminal leads and the ends of a fine wire that forms part of a bobbin assembly is designed so that the fine wire can be initially connected to the connector and the terminal lead can subsequently be connected to the connector through any one of several connection means. This arrangement considerably increases the versatility of the bobbin assembly since the same bobbin assembly can be utilized in different environments.

More specifically, the connection means between a terminal lead and a coil of fine wire includes a conductive tubular member that has an enlarged head at one end and the tubular member is received into an opening defined in a terminal block that forms part of the bobbin assembly or electrical coil. The terminal block also has a sleeve that defines an enlarged opening surrounding the tubular member to define a space around the portion of the tubular member and the tubular member is held in a fixed position through a permanent connection, such as a crimping action so that the tubular member is permanently connected to the terminal block. The enlarged head has an ear integral therewith that is connected to the fine wire.

The arrangement described above accommodates different connections for connecting the conductive core of an insulating lead wire to the tubular member. In one form, the lead wire has a tubular sleeve connected to the conductive core and the tubular sleeve is telescoped onto the tubular member to define a releasable connection between the two. In another version, the conductive core of the terminal lead is received into the tubular member and is permanently secured thereto by either crimping the terminal member or by soldering the conductive core into the tubular member. In a further modified form of the invention, the tubular member extends beyond the free end of the sleeve or terminal block and can then therefore be plugged directly into a receptacle member, such as a terminal lead connector that forms part of a circuit board.

DETAILED DESCRIPTION

Figure 1:
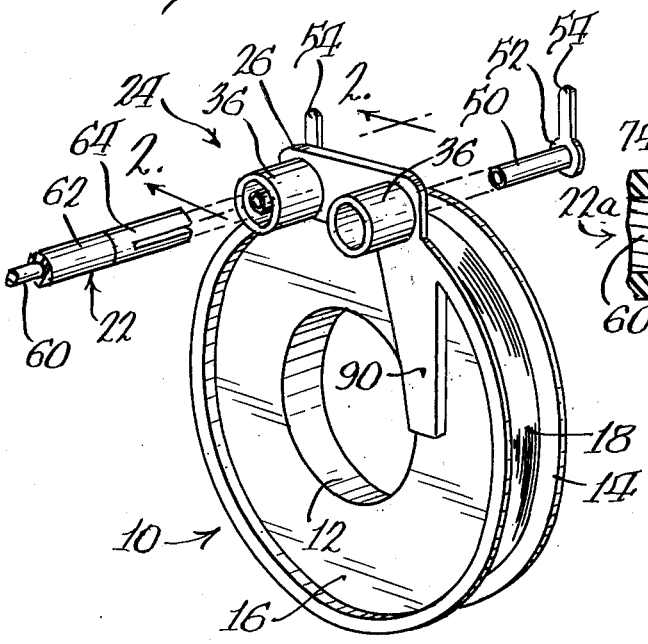
FIG. 1 shows a perspective view of the various components that form part of the electrical coil or bobbin assembly constructed according to the teachings of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

FIG. 1 of the drawings discloses a bobbin assembly or electrical coil generally designated by reference numeral 10. The electrical coil includes a bobbin that has a central circular portion or core 12 with a pair of flanges 14 and 16 extending from the central core and a coil of fine wire 18 wound upon the central portion in the space defined between flanges 14 and 16. The coil of fine wire 18 has two free ends 20 (only one being shown) which are adapted to be attached to a pair of terminal leads 22 (only one being shown).

Flange 16 has a terminal block, generally designated by the reference numeral 24, forming an integral part thereof and including an extension 26 which has a flat inner surface 28 that is slightly laterally offset from the inner surface 30 of flange 16. Integral extension 26 has a pair of spaced parallel aligned openings 32 extending therethrough to an opposed surface 34 which extends parallel to surface 28.

Terminal block 24 also has a pair of sleeves 36 integral with extension 26 and extending away from surface 34. Each sleeve 36 surrounds an opening 32 and has an internal opening 38 which is larger than opening 32 to produce a flat shoulder 40 between openings 38 and 32. Each sleeve 36 also has a free edge 42 which may be considered to be the outer end or surface of terminal block 24 that extends generally parallel to the inner surface 28 of extension 26.

According to the present invention, an inexpensive connector member is permanently secured to the terminal block for each end of the coil of fine wire 18 to provide a connection between the ends of the core of fine wire and the respective terminal leads 22. As more clearly illustrated in FIG. 2, the connector means consists of a generally tubular member 50 that is circular in cross section and has a peripheral dimension which is substantially equal to the size of opening 32 with an enlarged head or flange 52 integral with one end of tubular member 50. Enlarged flange or head 52 has an ear or lug 54 integral therewith to define a conductive connection between one end of fine wire 18 and tubular conductive member 50. This connection may be in the form of a solder connection (not shown).

Tubular member 50 is permanently secured to terminal block 24 through a very simple connection that can readily be made with automatic equipment. The permanent connection between tubular member 50 and terminal block 24 consists of a flange 56 that is produced intermediate opposite ends of tubular member 50 and engages shoulder 40 defined between enlarged portion 38 and reduced portion 32 of the opening in terminal block 24. This integral flange or shoulder 56 may be produced by deforming tubular member 50 by supporting the end 52 to prevent movement thereof and forcing the opposite free end to crimp or deform an intermediate portion of tubular member 50 and produce the crimp or flange 56.

The bobbin assembly so far described is particularly adapted for having terminal leads 22 connected thereto in a plurality of different forms without any modification of the basic components of the unit so far described. In the embodiment illustrated in FIG. 1, the connection means between the conductive core of terminal lead 22 and the end 20 of fine wire 18 is in the form of a plug-in type connection. As is customary in the electrical coil art, the terminal lead 22 has a circular center conductive portion 60 which is normally circular in cross section and has an insulation 62 surrounding the central conductive core 60.

In the embodiment illustrated in FIG. 1, central core 60 of terminal lead 22 is permanently connected to a conductive tubular metal sleeve 64 that has an internal opening which corresponds to the peripheral diameter of tubular sleeve 50 so that the tubular sleeve can be telescoped over tubular member 50 to produce a conductive connection between conductive core 60 and end 20 of fine wire 18.

There are several distinct advantages of providing a quick release disconnect coupling between terminal lead 22 and each end 20 of the coil of fine wire 18. The primary advantage is in shipment of the units to their ultimate destination. Heretofore it was deemed necessary to provide a permanent connection between the lead wires 22 and the coil of fine wire 18 during the production of the electrical coil. Because of the size and length of the terminal lead, the generally flat bobbin assembly with the terminal leads connected thereto was a difficult item to package. By having the terminal leads readily disconnected, the terminal leads can be shipped separated from the remainder of the bobbin assembly and can be inserted at the time the electrical coil is placed into its operative environment. Another advantage of the quick release coupling between the terminal leads and the coil of fine wire is that the same bobbin assembly 10 can be utilized for connecting terminal leads of different sizes and configurations. It is only necessary to connect sleeve 64 to any conductive portion 60 of any terminal lead and then plug the tubular sleeve 64 into the respective annular opening surrounding tubular members 50 to provide the conductive connection.

Figure 4:
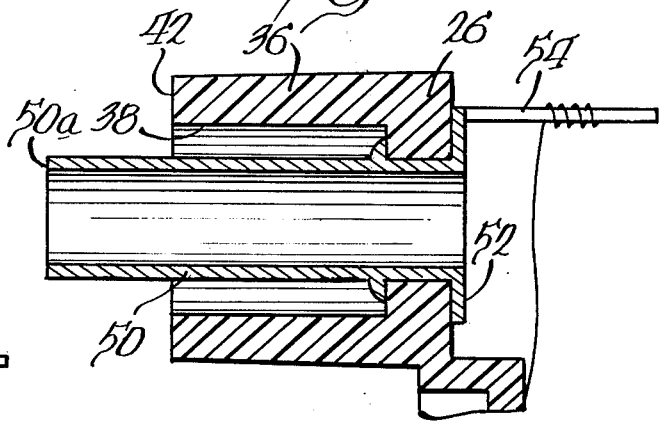
FIG. 4 is a slightly modified form of the invention particularly adapted for plug-in type circuit board arrangements.
Figure 2:
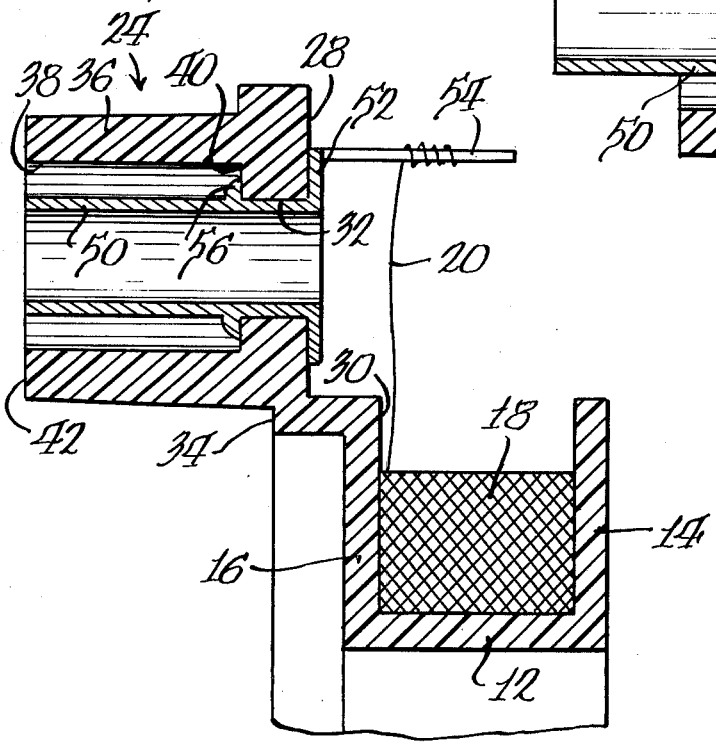
FIG. 2 is a fragmentary sectional view, as viewed along line 2—2 of FIG. 1 showing the bobbin assembly with the connector member permanently secured thereto.

A slightly modified form of connection means between tubular member 50 and the terminal lead 22 is illustrated in FIG. 4 wherein all reference numerals described in connection with the embodiment of FIG. 2 have been repeated. In this embodiment of the invention, tubular member 50 has a free end portion **50*a* which extends beyond the free edge or surface 42 of terminal block 24. This version of the invention is particularly adapted for use with printed circuit boards wherein the terminal lead has a tubular sleeve portion equivalent to sleeve 64 located below the surface of the printed circuit board. With this arrangement, the periphery of tubular member 50 extending beyond surface 42** could readily be plugged into a circular opening or recess defined in the circuit board.

Figure 3:
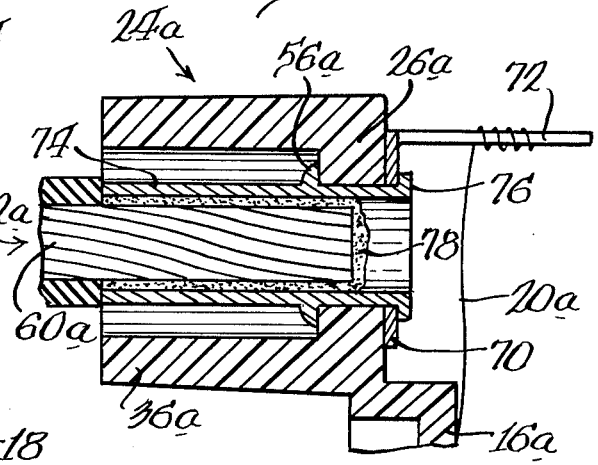
FIG. 3 is a view similar to FIG. 2 showing one manner of connecting the terminal lead wire to the connector.

A slightly further modified form of the invention is illustrated in FIG. 3 wherein an alternate type of connection means between the tubular member and the terminal lead is shown. In the embodiment illustrated in FIG. 3, a terminal block **24*a* identical to terminal block 24 is formed as an integral extension of flange 16*a* and terminal block 24*a* again includes an integral extension 26*a* which has a pair of integral sleeves 36*a* extending from the outer flat surface thereof. In this embodiment of the invention, a flat metal disc 70 which has an ear or lug 72 extending therefrom cooperates with a tubular member 74 that has an enlarged head 76 at one end thereof. Ear or lug 72 is again attached to one end 20*a* of a coil of fine wire preferably through a solder connection. Tubular member 74 is again permanently attached to terminal block 24*a* through a crimp or integral flange 56*a* and is in conductive contact with disc 70 at one end thereof. In this embodiment of the invention, the conductive core 60*a* of terminal lead 22*a* is received into the internal opening of tubular member 74 and is permanently secured therein. In the illustrated embodiment, the permanent securement is in the form of a solder connection 78. Of course, it will be appreciated that the connection between the terminal lead conductive core and the tubular member illustrated in FIG. 3 could also be utilized as an alternate connection between the terminal lead 22 and tubular member 50 illustrated in the embodiment of FIG. 2**.

In all embodiments of the invention, one flange 16 having the terminal block 24 secured thereto has an integral enlarged portion 90 which extends from the exposed surface of flange 16. Enlarged portion 90 has a recess extending from the center of the core with the base of the recess (not shown) spaced from surface 30 of flange 16 so that the inner end of the coil of fine wire 18 can be located in this recess and have the area between flanges 14 and 16 completely unobstructed during the winding of the fine wire onto the central portion 12. Preferably, in assembling the various components, the integral ears 54 of the respective tubular members 50 are initially in a position illustrated in FIG. 1 wherein the ears are spaced outwardly of the inner surface 30 of flange 16 to again allow automatic winding of the coil of fine wire onto central core 12 without any obstruction. After the coil of fine wire has been wound upon central core 12, the ears are then preferably bent to the position illustrated in FIGS. 2, 3 or 4. By having the ears extending vertically or parallel to flange 16 at a location outside of the space between flanges 14 and 16, one end of the coil of fine wire can initially be wound upon one ear 54, inserted into the recess defined in enlarged portion 90 and then have the remainder of the coil of fine wire wound upon central core 12. The opposite end can then be wound upon the other ear 54 and the two ends of the coil of fine wire can then be permanently connected to the respective ears 54 before the ears are bent to a position extending generally parallel to the axis of tubular member 50.

In all embodiments of the invention, a cover (not shown) generally similar to the cover illustrated in U.S. Pat. No. 4,105,985, may be utilized to completely enclose the coil of fine wire as well as the permanent connection between conductive tubular member 50 and opposite ends 20 of the coil of fine wire.

As can be appreciated from the above description, the present invention provides an extremely simple connection means for connecting a fine wire to a terminal lead in a variety of different forms of connections. Furthermore, the basic bobbin assembly can readily be completely assembled and fully enclosed and the terminal lead can then be attached to the bobbin assembly at the point of ultimate use in a variety of different forms.

What is claimed is:

1. In an electrical coil having a bobbin including a central portion and at least one flange extending from said central portion and having a nonconductive terminal block integral with a peripheral portion thereof, said terminal block having opposed surfaces, a coil of fine wire wound about said central portion and having exposed free ends, a lead wire having a central conductive core and insulation surrounding said conductive core, and connection means between said conductive core and a free end of said fine wire, the improvement of said connection means including a conductive tubular member having an enlarged head at one end and an opening therethrough, said terminal block having an opening between said surfaces and receiving said tubular member with said enlarged head engaging one of said surfaces of said terminal block adjacent said central portion, said opening in said terminal block having an enlarged portion extending from the other of said surfaces to define a space around a portion of said tubular member, first means forming part of said tubular member permanently connecting said tubular member to said terminal block, second means defining a conductive connection between one end of said fine wire and said tubular member, and third means defining a conductive connection between said conductive core and said tubular member.

2. An electrical core as defined in claim 1, in which said third means includes a tubular sleeve connected to said conductive core and telescoped on said tubular member.

3. An electrical core as defined in claim 1, in which said second means includes an ear integral with said enlarged head with said end of said fine wire permanently connected to said ear.

4. An electrical core as defined in claim 3, in which said conductive core is received into said opening in said tubular member and secured therein to define said third means.

5. An electrical core as defined in claim 1, in which said enlarged portion of said opening has a shoulder at its inner end extending generally parallel to said one of said surfaces and said tubular member has a flange engaging said shoulder to define said first means.

6. In an electrical coil having a bobbin including a central core and a pair of spaced parallel flanges extending from said core with a coil of fine wire wound upon said core, an extension integral with one of said flanges and having a pair of spaced openings, a pair of spaced parallel sleeves integral with said extension and respectively surrounding said openings, said sleeves extending away from said flanges and cooperating with said extension to define a terminal block, a pair of conductive tubular members respectively received in said openings, said tubular members each having an enlarged head engaging one surface of said extension and an intermediate portion engaging an opposed surface of said extension to permanently connect said tubular members, said tubular members respectively having peripheral surfaces spaced from the internal surfaces of said sleeves, and a conductive ear integral with each enlarged head with free ends of said fine wire respectively connected to said ears.

7. An electrical coil as defined in claim 6, in which said tubular members respectively extend beyond free ends of said sleeves.

* * * * *